United States Patent [19]

Bergmans

[11] 4,455,767

[45] Jun. 26, 1984

[54] SHOE CONSTRUCTION

[75] Inventor: Charles Bergmans, Sprang-Capelle, Netherlands

[73] Assignee: Clarks of England, Inc., Norwalk, Conn.

[21] Appl. No.: 258,580

[22] Filed: Apr. 29, 1981

[51] Int. Cl.[3] ..... A43B 13/18; A43B 13/04; A43C 13/08

[52] U.S. Cl. ..... 36/83; 36/14; 36/28; 36/32 R

[58] Field of Search ..... 36/83, 14, 28, 25 R, 36/32 R

[56] References Cited

U.S. PATENT DOCUMENTS

| | | | |
|---|---|---|---|
| 1,622,860 | 3/1927 | Cutler | 36/14 |
| 3,416,174 | 12/1968 | Novitske | 36/14 |
| 4,333,192 | 6/1982 | Stockli et al. | 36/14 |

*Primary Examiner*—Patrick D. Lawson

*Attorney, Agent, or Firm*—St. Onge, Steward, Johnston & Reens

[57] ABSTRACT

An improved shoe construction to be worn on a human foot includes a foot bag made of sheet-like material as a unitary structure. The foot bag comprises an inner sole for underlying and that conforms generally to at least the lower surfaces of the toes, sole and heel of the foot. The foot bag also includes an outer covering for overlying and that conforms generally to the upper surfaces of the toes and the instep of the foot and to the side surfaces of the heel of the foot. The inner sole and lower edges of the outer covering meet at and are joined together at at least a portion of the periphery of the inner sole. The shoe construction further includes a flexible outer sole member that has an upper foot bed surface for underlying and supporting and that conforms generally to the lower surfaces of the toes, sole and heel of the foot. A peripheral side wall having an inwardly facing surface extends upwardly and continuously from the foot bed surface of the sole member and is bonded to surfaces of the outer covering in the region of the juncture of the lower edges of the outer covering and the inner sole to lie closely adjacent and conceal the juncture.

20 Claims, 6 Drawing Figures

28
24
46
26
50
30
46
28
52
46
50
18
20
10
12
14
16
11
40
44
48
22
54
42
36
34
38
32
60
56
58

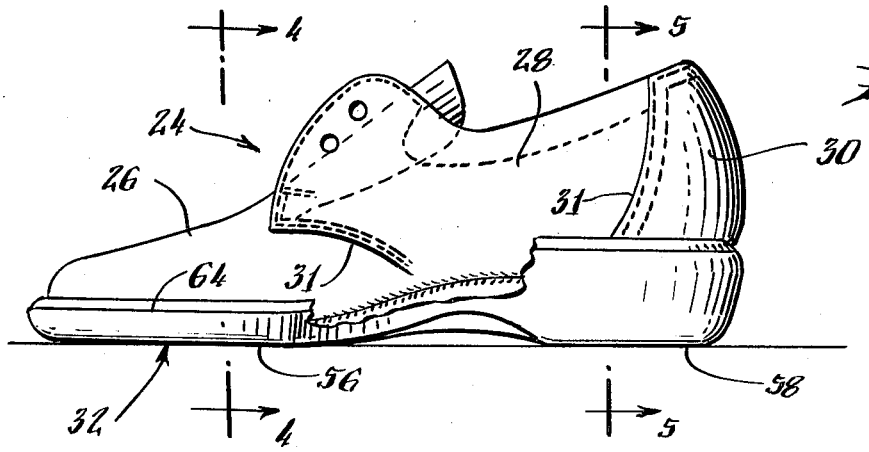
Fig. 2.
Fig. 3.
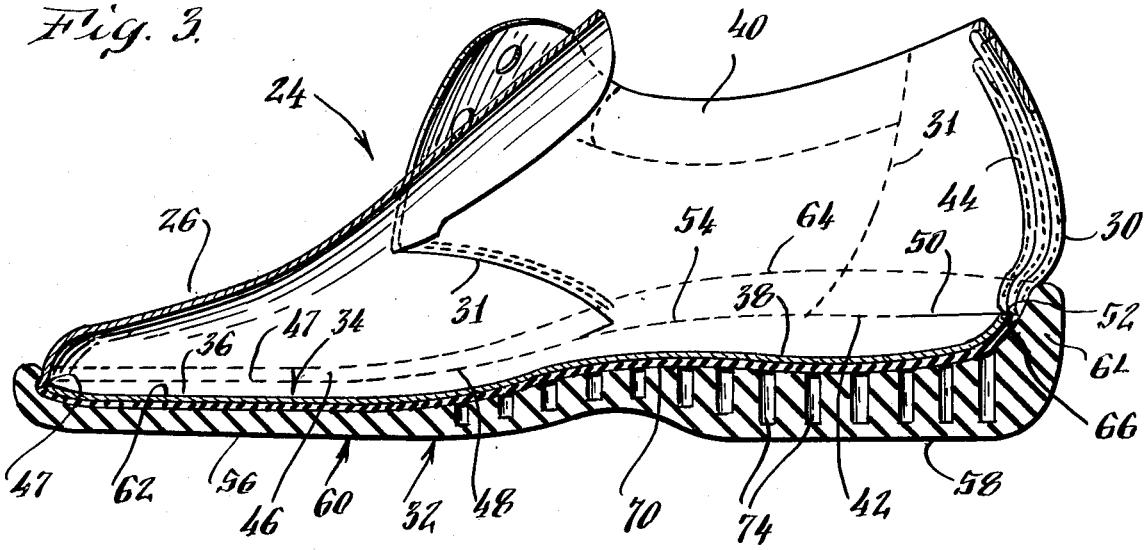
Fig. 4.
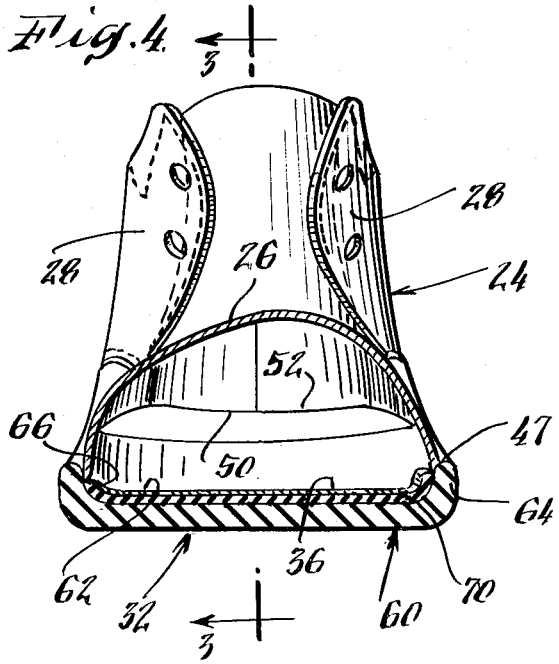
Fig. 5.
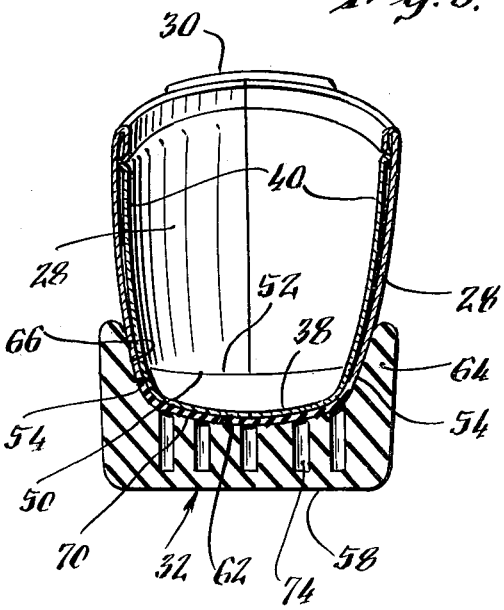

SHOE CONSTRUCTION

BACKGROUND OF THE INVENTION

1. Field of The Invention

The present invention relates to an improved shoe construction and particularly to an improved shoe construction especially designed for extraordinary comfort and handsome appearance.

2. Description of The Prior Art

Most commercially available shoes have a basic, well known design. Such shoes typically include a sole made of a relatively thick sheet of leather or other material having a peripheral shape that approximates the outline of the human foot on which the shoe is to be worn. An upper, made of a thinner sheet of leather or other material, is stitched directly to the sole and a relatively thick heel usually made of leather or rubber is attached by tacks or other means to the base of the sole to elevate the heel of the foot on which the shoe is worn relative to the toes.

Among the primary concerns in the design of shoes are comfort and appearance. In the past, attempts have been made to make shoes of the conventional design generally described above more comfortable by using higher, more supple grades of leather materials to make them and by cushioning the sole with various resilient materials.

SUMMARY OF THE INVENTION

It is an object of the present invention to provide a new shoe construction, one of the primary purposes of which is to offer unparalleled wearing comfort.

It is also an object of the present invention to provide an improved shoe construction that has a handsome appearance.

The improved shoe construction, in general accordance with the present invention, includes a foot bag made of sheet-like material as a unitary structure. The foot bag includes an inner sole, forming part of an inner lining, for underlying and that conforms generally to the contours of at least the lower surfaces of the toes, sole, and heel of the foot on which the shoe is to be worn. The foot bag also includes an outer covering for overlying and that conforms generally to the contours of the upper surfaces of the toes, the instep and the side surfaces of the heel of the foot. The inner sole and lower edges of the outer covering meet at and are joined together at at least a portion of the periphery of the inner sole. Accordingly, the foot bag surrounds the major portions of the foot and is essentially molded to the contours of the exterior surfaces of those portions. Moreover, the contoured inner sole tends to craddle the lower surfaces of the foot.

The improved shoe construction in general accordance with the present invention also includes a flexible outer sole member having an upper support or foot bed surface also for underlying and that conforms generally to the contour of the lower surfaces of the toes, sole, and heel of the foot. A peripheral side wall having an inwardly facing surface extends upwardly and continuously from the foot bed of the outer sole. The shoe construction is assembled by joining the foot bag to the outer sole member with the inner sole conforming to and supported by the foot bed surface. The peripheral side wall is bonded to the surfaces of the outer covering of the foot bag adjacent the juncture of the lower edges of the outer covering and the inner sole to thereby lie closely adjacent and conceal this juncture.

Since the foot bag is assembled with the sole member with the inner sole bonded to the foot bed surface of the sole member, the inner sole conforms to the contour of the foot bed surface as mentioned above. Accordingly, the foot is cradled by both the inner sole of the foot bag and by the foot bed surface of the sole member to provide extraordinary wearing comfort.

The placement of the peripheral side wall of the sole member and bonding of it to surfaces of the outer covering adjacent the juncture between the inner sole and outer covering of the foot bag further secures the foot bag to the sole member, conceals the juncture, and reinforces the juncture. The appearance of the shoe is enhanced by concealment of the juncture by the periphery side wall. Therefore, this shoe construction of the invention is very pleasing.

Accordingly, the improved shoe construction of the present invention represents a substantial improvement over conventional shoe designs.

Additional objects, aspects, and features of the present invention will be pointed out in or will be understood from the detailed description provided below in conjunction with the accompanying drawings.

BRIEF DESCRIPTION OF THE DRAWINGS

FIG. 2 is a side elevational view of the improved shoe construction of the present invention, shown after it has been assembled and partly cut away to show the relationship of the peripheral side wall of the sole member to the juncture of the inner sole and outer covering of the foot bag.

FIG. 3 is a longitudinal vertical cross-sectional view of the shoe construction of the invention taken through plane 3—3 in FIG. 4.

FIG. 4 is a lateral vertical cross-sectional view of the toe region of this shoe construction taken through plane 4—4 in FIG. 2 and looking rearwardly toward the heel region.

FIG. 5 is a vertical cross-sectional view of the heel region of this shoe construction taken through plane 5—5 in FIG. 2 looking rearwardly.

DETAILED DESCRIPTION OF THE PREFERRED EMBODIMENTS

Figure 1:
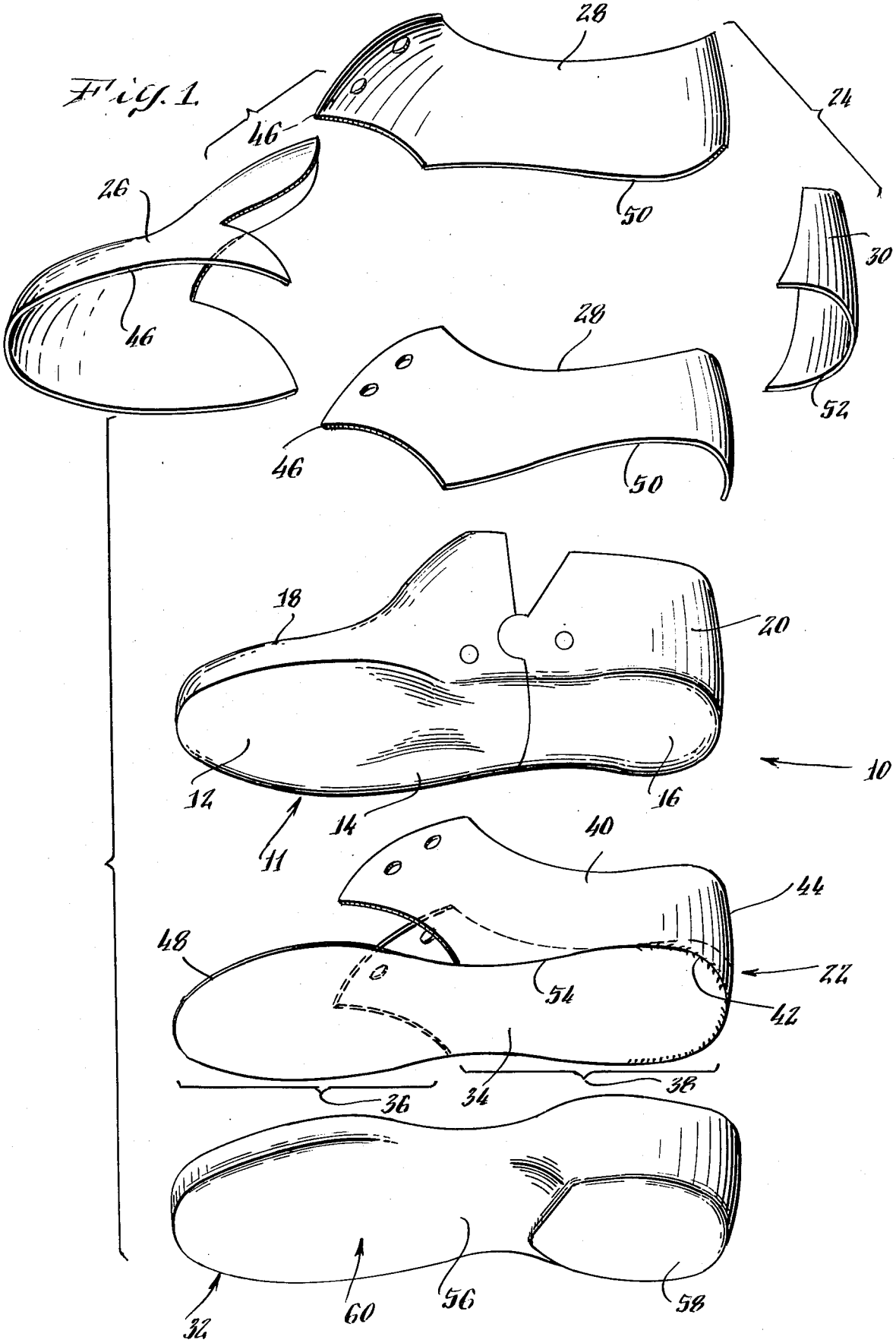
FIG. 1 is an exploded perspective view of the components of the shoe construction of the present invention shown positioned about a specially contoured base on which these components are assembled.

FIG. 1 illustrates the various components of a first embodiment of the improved shoe construction of the present invention as an exploded perspective. Each of these components is shown positioned about a specially contoured last used to form several of them and to which others also conform. As can be seen in FIG. 1, the last, generally indicated at 10, is anatomically formed to approximate the overall shape or contour of the human foot of size for which the shoe construction is made. The last includes a bottom exterior surface generally indicated at 11 having a toe region 12, a sole region 14 that includes the arch and a heel region 16, each of which generally conform to the contours of the bottom surfaces of the respective portions of the foot. The last further includes an upper exterior surface 18 that conforms generally to the contour of the upper surfaces of the toes and instep of the foot and a side exterior surface 20 that conforms generally to the contour of the side surface of the heel of the foot.

It will be understood for purposes of the specification and the concluding claims that various surfaces of the last and foot described above do not necessarily have easily defined or distinct boundries but rather one surface forms a generally smooth and continuous extension of another. However, for such purposes, these regions are denoted as separate to aid description and understanding of the invention.

As will be described in greater detail below, the various components of the shoe construction of the present invention are assembled about and conform to the contours of the exterior surfaces of the last 10. It is this contouring of all of the internal and foot supporting surfaces of the shoe construction to the shape of the foot, described more fully below, that provides the unparalleled wearing comfort of this shoe construction.

As can further be seen in FIG. 1, the shoe construction of the first embodiment of the invention includes an inner lining generally indicated at 22, an outer covering generally indicated at 24 having several separate components 26, 28, and 30 described below in detail, and a flexible outer sole member generally indicated at 32.

In this first preferred embodiment the inner lining 22 comprises an inner sole 34 that includes a forward or toe portion 36 for underlying and generally conforming to the contour of the lower surfaces of the toe region 12 and a forward portion of the sole region 14 of the last and hence the foot. The inner sole further includes a rearward portion 38 for underlying and generally conforming to the contour of the lower surfaces of a rearward portion of the sole region 14 and the heel region 16 of the last and hence the foot.

The inner lining further includes inner sides 40, forming inner side linings of the finished shoe construction, that are folded upwardly from the rearward portion 38 of the inner sole 34 and are mated with and stitched along a short section 42 of the periphery of the rearward portion of the inner sole and vertically along a line 44 on the heel. This folding assembly and stitching at peripheral section 42 and line 44 are performed adjacent the last so that the inner lining tightly conforms to the surface of the last as mentioned above and consequently tightly conforms to the contour of the exterior surfaces of the foot on which the shoe is to be worn.

The outer covering 24, as noted above, includes several separate components that include a forward or toe section 26 which forms an outer and upper surface for overlying and conforming generally to the contour of the upper surfaces 18 of the toes and of the forward portion or instep of the last and hence the foot. A pair of side sections 28 and a heel section 30 overlie and generally conform to the side exterior surfaces 20 of the instep and heel of the last and consequently the foot. These components 26, 28, and 30 of the upper outer covering are assembled as a unitary structure, for example, by stitching 31 (FIGS. 2 and 3). These components are, furthermore, assembled and stitched together to conform closely to the contour of the upper toe and instep surfaces 18 and side surfaces 20 of the last 10 and hence of the foot.

It will be understood that other combinations of components for the outer covering having different peripheral but not different contour shapes from those shown in FIG. 1 may be provided depending upon the style of the shoe to be made.

The inner lining and outer covering are ultimately assembled together about the last 10 to form, as a unitary structure, a foot bag that conforms generally to the contour of all surfaces of the foot to be covered by the shoe construction, namely, the lower toe, sole and heel region surfaces and the upper toe and instep surfaces and side surfaces of the foot. More particularly, lower edges 46 of the toe section 26 of the outer covering 24, which extend downwardly to the periphery of the bottom exterior surfaces of the last, are joined, for example, by stitching 47, to at least the periphery 48 of the forward inner sole portion 36. When assembled, the lower edges 50 and 52 respectively of the side and heel sections 28 and 30 of the outer covering, also extend downwardly to the periphery of the bottom exterior surfaces of the last and lie closely adjacent the periphery 54, including the peripheral section 42, of the rearward inner sole portion 38. These lower edges 50 and 52 may or may not be stitched to the periphery 54. Accordingly, the unitary foot bag construction when placed on the foot completely surrounds and conforms to the contour of the exterior surfaces of the foot. In the preferred embodiments, the materials of which the various parts of the foot bag are made are supple leather. The foot bag then acts as a soft leather sock.

The sole member 32 of the shoe construction of the invention is also molded to conform to portions of the last 10 and hence the foot on which the shoe is to be worn. The sole member is molded from an elastomeric material such as crape rubber. As shown in FIGS. 1 through 5, the sole member includes a forward portion 56 for generally supporting the lower surface of the foot corresponding to the toe region 12 and sole region 14 and and a rearward portion 58 for supporting the heel region 16 of the last. More particularly, the sole member includes a bottom surface 60 and an opposed, upwardly facing support or foot bed surface 62. Over the forward portion 56 of the sole member, the foot bed surface 62 is formed to underlie and conform generally to the contour of the lower surfaces of the toe and sole regions, 12 and 14, of the last. Over the rearward portion 58 of the sole member, the foot bed surface 62 is formed to underlie and conform generally to the contour of the lower surface of the heel region 16 of the last. Accordingly, rather than being formed as a generally flat piece of leather or other sole material, the sole member of the improved shoe construction of the present invention is formed to the contour of the wearer's foot, again to improve wearing comfort.

As can be seen in FIGS. 2 through 5, the sole member further includes a peripheral side wall 64, extending upwardly at the periphery of the sole member, that defines an inwardly facing surface 66 which extends upwardly and continuously from the foot bed surface 62. In the assembled shoe construction, this side wall is bonded using known adhesives, to outer surfaces of the toe section 26, side sections 28 and heel section 30 immediately adjacent the lower edges 46, 50 and 52 of these respective components of the outer covering and over the juncture of these lower edges and the periphery 48 and 54 of the inner sole. Accordingly, stitching 47 about the periphery 48 between the toe section 26 and the forward portion 36 of the inner sole, is hidden by the peripheral side wall 64 as can be seen in FIG. 2 and as depicted in FIGS. 3, 4 and 5. Further, the juncture of the lower edges 50 and 52 with the periphery 54 of the inner sole 34 is also hidden whether or not the two components are stitched together at this juncture.

The continuity between the inwardly facing surface 66 of the peripheral side wall 64 and the foot bed surface 62 of the the sole member improves the support and hence the comfort for the lower surfaces of the foot on which the shoe is worn. Further, the bonding of the peripheral side wall to outwardly facing surfaces immediately adajcent the lower edges of the components of the outer covering also improves the resistance of the stitching to wear and failure.

The weight of the sole member may be decreased by removing cylinders of material leaving partial bores 74 in the heel region. However, only quantities of material that are insufficient to impair the ability of the sole member to provide support for the wearer are removed.

In assembly, the inner sole 34 of the foot bag is bonded to the support surface 62 of the sole member with the peripheral side wall 64 overlying surfaces of the lower edged bonded thereto as mentioned above to conceal the junctures between the outer covering and the inner sole.

To further enhance the comfort of the shoe construction of the present invention, a thin layer of a porous elastomeric material 70 may be bonded between the upper support surface 62 of the sole member 32 and the lower surface of the inner sole 34. In the first preferred embodiment, this elastomeric material is rubber. By virtue of its porosity, it is "breathable."

Figure 6:
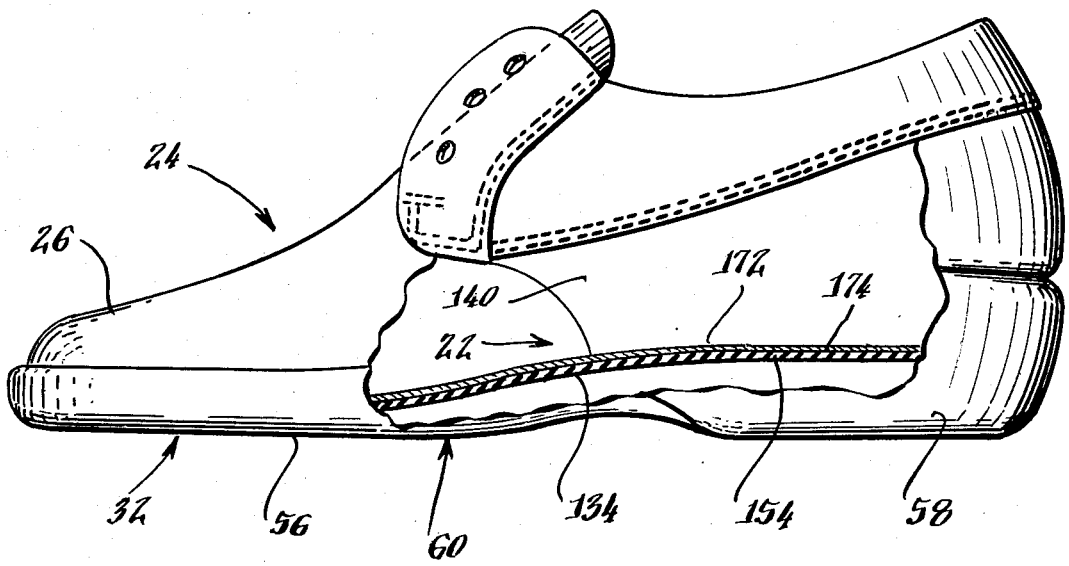
FIG. 6 is a side elevational view, similar to that shown in FIG. 2, of an alternative embodiment of the shoe construction of the invention.

A second embodiment of the present invention is shown in FIG. 6 and differs from the first embodiment primarily in the construction of the inner lining. More particularly, in the second embodiment, the inner sole 134 and inner sides 140 are formed as separate pieces of sheet-like material, preferably leather. The lower edges 172 of the inner sides are joined as, for example, by stitching 174, to the periphery 154 of the rearward portion of the inner sole.

It will be appreciated that the shoe construction of the present invention provides improved comfort for the wearer, may be designed in various styles that are esthetically pleasing, and also provides improved wear characteristics due to the unique structure of the shoe bag and in its bonded mating with the foot bed surface and inwardly facing surfaces of the peripheral side wall of the outer sole member.

Accordingly, although specific embodiments of the present invention have been described above in detail, it is to be understood that this is for purposes of illustration. Modifications may be made to the described structures in order to adapt them to particular applications.

What is claimed is:

1. An improved shoe construction to be worn on a human foot comprising:

an inner lining including a forward inner sole for underlying and that conforms generally to the contour of the lower surfaces of the toes and a forward portion of the sole of said foot, a rearward inner sole for underlying and that conforms generally to the contour of the lower surfaces of a rearward portion of the sole and the heel of said foot, and inner sides for lying adjacent and conforming generally to the side and upper surfaces respectively of the heel and the instep of said foot, said inner sides being folded upwardly and joined to said rearward inner sole at the periphery of said rearward inner sole;

an outer covering including a forward outer and upper section for overlying and that conforms generally to the contour of the upper surfaces of said toes and said forward portion of said foot, and a rearward outer and upper section lying adjacent said inner sides of said inner lining, lower edges of at least said forward section of said outer covering being joined to said inner lining at least at the periphery of said forward inner sole, said outer covering together with said inner lining thereby forming as a unitary structure a foot bag that conforms generally to the contour of the surfaces of said foot to be covered by said construction; and a flexible outer sole member having an upper foot bed surface also for underlying and that conforms generally to the contour of said lower surfaces of said toes, said forward and rearward portions of the sole, and said heel of said foot and being bonded to said forward and rearward inner soles of said inner lining, and a peripheral side wall having an inwardly facing surface that extends upwardly and continuously from said foot bed surface and is bonded to surfaces of said outer covering immediately adjacent said lower edges and over the juncture of said lower edges and the periphery of said forward inner sole of said inner lining to thereby conceal said juncture.

2. The improved shoe construction of claim 1, said inner lining being formed of a single piece of sheet-like material.

3. The improved shoe construction of claim 1, said forward and rearward inner soles of said inner lining being forming as a single piece of sheet-like material, said inner sides of said inner lining being formed of at least one piece of sheet-like material having a lower edge joined to the periphery of said rearward inner sole and wherein said side wall of said sole member lies closely adjacent and also conceals the juncture of said inner sides and periphery of said rearward inner sole.

4. The improved shoe construction of claims 2 or 3, wherein lower edges of said rearward section of said outer covering lie in the region of the juncture of said inner sides and the periphery of said rearward inner sole and wherein said side wall of said sole member covers and is bonded to surfaces of said rearward section of said outer covering immediately adjacent said lower edges of said rearward section of said outer covering to thereby conceal said juncture between said periphery of said rearward inner sole and said inner sides.

5. The improved shoe construction of claims 1, 2 or 3, further comprising cushion means bonded between said forward and rearward inner soles of said inner lining and said foot bed surface of said sole member.

6. The improved shoe construction of claim 5 wherein said cushion means comprises a thin sheet of porous elastomeric material.

7. The improved shoe construction of claim 6 wherein said elastomeric material is rubber.

8. An improved shoe construction to be worn on a human foot comprising:

a foot bag made as a unitary structure of sheet-like material and including an inner sole for underlying and that conforms generally to at least the lower surfaces of the toes, sole, and heel of said foot, and an outer covering for overlying and that conforms generally to the upper surfaces of said toes and the instep of said foot and the side surfaces of the heel of said foot, said inner sole and lower edges of said outer covering meeting at and being joined together at at least a portion of the periphery of said inner sole, said inner sides being folded upwardly from and joined to a rearward portion of said inner sole at the periphery thereof; and a flexible outer sole member having an upper foot bed surface also for underlying and that conforms generally to the lower surfaces of said toes, said sole, and said heel of said foot, and a peripheral side wall having an inwardly facing surface that extends upwardly and continuously from said foot bed surface and is bonded to surfaces of said outer covering immediately adjacent the juncture of said lower edges of said outer covering and said inner sole to conceal said juncture.

9. The improved shoe construction claimed in claim 8, said foot bag further including inner sides for lying closely adjacent and that conform generally to the side and upper surfaces respectively of said heel and said instep of said foot and positioned therebetween and similar portions of said outer covering.

10. The improved shoe construction claimed in claim 9, said inner sole and said inner sides of said foot bag being formed of a single piece of sheet-like material.

11. The improved shoe construction claimed in claim 9, wherein said inner sole is formed of a single piece of sheet-like material, wherein said inner sides are formed of at least one piece of sheet-like material having a lower edge joined to the periphery of a rearward portion of said inner sole, and wherein said side wall of said sole member also lies closely adjacent and conceals the juncture of said inner sides and the periphery of said rearward portion of said inner sole.

12. The improved shoe construction claimed in claim 10 or 11, wherein at least a portion of the lower edges of said outer covering lies closely adjacent the juncture of said inner sides and the periphery of said rearward portion of said inner sole and wherein said side wall of said sole member is bonded to surfaces of said outer covering immediately adjacent said portion of said lower edges of said outer covering to thereby conceal said juncture between said periphery of said rearward portion of said inner sole and said inner sides.

13. The improved shoe construction claimed in claim 8, 9 or 10 further comprising cushion means bonded between said inner sole of said foot bag and said upper surface of said sole member.

14. The improved shoe construction claimed in claim 13 wherein said cushion means comprises a thin sheet of porous elastomeric material.

15. The improved shoe construction claimed in claim 14 wherein said elastomeric material is rubber.

16. A method of making an improved shoe construction to be worn on a human foot comprising the steps of:

providing a last having a lower exterior surface conforming generally to the contour of lower surfaces of the toes, sole, and heel of said foot, an upper exterior surface conforming generally to the contour of the upper surfaces of the toes and instep of said foot, and a side exterior surface conforming generally to the contour of the side surfaces of the heel of said foot;

conforming an inner sole generally to the contour of the lower exterior surface of said last;

folding said inner sides upwardly and joining them to the periphery of a rearward portion of said inner sole;

conforming an outer covering generally to the contour of the upper and side exterior surfaces of said last so that lower edges of said outer covering lie closely adjacent the periphery of said inner sole;

joining said lower edges of said outer covering to at least a portion of said periphery of said inner sole to thereby form a foot bag that will generally conform to all said surfaces of said foot;

forming a flexible sole member with an upper foot bed surface that also conforms generally to the contour of said lower surfaces of the toes, sole, and heel of said foot and with a peripheral side wall having an inner surface that extends upwardly and continuously from said foot bed surface;

bonding said inner sole in confronting and conforming relation to said foot bed surface and with said side wall overlying the juncture of said lower edges of said outer covering and said periphery of said inner sole; and bonding said side wall of said sole member to surfaces of said outer covering immediately adjacent said lower edges thereof to conceal said juncture.

17. The method of claim 16 further comprising conforming inner sides to said side exterior surface and at least a portion of said upper exterior surface of said last and joining said inner sides to similar portions of said outer covering.

18. The method of claim 17 wherein said inner sole and said inner sides are formed of a single piece of sheet-like material.

19. The method of claim 17 wherein said inner sole is formed of a single piece of sheet-like material and said inner sides are formed of at least one piece of sheet-like material having a lower edge and wherein said method further comprises:

joining said lower edge of said inner sides to the periphery of a rearward portion of said inner sole; and wherein said first bonding step further comprises positioning said side wall to also overlie the juncture between said lower edge of said inner sides and the periphery of said rearward portion of said inner sole whereby said second bonding step also conceals said last-recited juncture.

20. The method of claims 16, 17, 18, or 19 further comprising bonding a thin sheet-like cushion material between said inner sole and said foot bed surface.

* * * * *